US007083477B1

(12) United States Patent
Brodsky et al.

(10) Patent No.: US 7,083,477 B1
(45) Date of Patent: Aug. 1, 2006

(54) PROVIDING MECHANICAL SUPPORT FOR MODULAR INTERCONNECT SYSTEMS

(75) Inventors: William Louis Brodsky, Binghamton, NY (US); Michael F. Scanlon, Poughkeepsie, NY (US); John G. Torok, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/193,822

(22) Filed: Jul. 29, 2005

(51) Int. Cl.
*H01R 9/22* (2006.01)

(52) U.S. Cl. ..... 439/712

(58) Field of Classification Search ..... 439/701, 439/711–718, 157, 347, 372
See application file for complete search history.

(56) References Cited

U.S. PATENT DOCUMENTS 3,189,866 A * 6/1965 Lazar ..... 439/717
3,377,614 A * 4/1968 Powell et al. ..... 439/716
3,547,274 A * 12/1970 Sosinkski ..... 211/89.01
3,559,813 A * 2/1971 Sosinski ..... 211/89.01
4,090,764 A * 5/1978 Malsby et al. ..... 439/471
4,790,763 A * 12/1988 Weber et al. ..... 439/65
4,797,123 A * 1/1989 Weber ..... 439/717
4,820,169 A * 4/1989 Weber et al. ..... 439/65
5,795,174 A * 8/1998 Saito et al. ..... 439/310
5,919,053 A * 7/1999 Tsuji et al. ..... 439/157
6,059,615 A * 5/2000 Pendleton et al. ..... 439/717
6,149,447 A * 11/2000 Maeda et al. ..... 439/157
6,227,894 B1 * 5/2001 Maeda et al. ..... 439/347
6,241,539 B1 * 6/2001 Sato et al. ..... 439/157
6,345,996 B1 * 2/2002 Saito et al. ..... 439/159
6,498,730 B1 * 12/2002 Centola et al. ..... 361/759
6,791,843 B1 * 9/2004 Dobbs et al. ..... 361/758

* cited by examiner

*Primary Examiner*—Ross N. Gushi
(74) *Attorney, Agent, or Firm*—Rabin & Berdo, P.C.

(57) ABSTRACT

A connector system includes a first connector assembly that is electrically connected to wiring on a first printed wiring board and a second connector assembly that is electrically connected to wiring on a second printed wiring board. Each connector assembly includes a number of connector modules that are joined together in a predetermined array such as a row. In one of the connector assemblies, the row also includes one or more actuation modules. The actuation module or modules are engaged by an actuator mechanism to force the connector assemblies into mating engagement or to draw them apart.

12 Claims, 3 Drawing Sheets

PROVIDING MECHANICAL SUPPORT FOR MODULAR INTERCONNECT SYSTEMS

BACKGROUND OF THE INVENTION

The present invention is directed to electrical connector systems, and more particularly to connector systems that are employed to provide electrical connections with circuitry on printed wiring boards.

The increasing complexity of computers and other electrical equipment brings with it increasing demands on connector systems that are used with printed wiring boards in the equipment. Many signals may need to be conveyed between different printed wiring boards (which will hereafter be called PWCs), and considerable power may be drawn by the circuitry on the PWCs. The power demands of the PWCs and the number of signal connections that are needed typically differ from PWC to PWC.

FIG. 1 schematically illustrates a connector assembly 10 that includes a number of connector modules 12 which are mounted on an organizer 14. Different types of modules 12 are commercially available (for example, from Molex Inc., having an office at 2222 Wellington Court, Lisle, Ill. 60532, U.S.A.) for conveying power and signals. Each type of module is available in a male variety that is matable with a complementary female variety.

FIG. 2 shows examples of various commercially available male connector modules. The modules marked 12*a*, 12*b*, and 12*d* are typically used to transfer electrical power, and the module marked 12*c* is used for conveying signals. The module 12*a*, for example, includes a single contact conductor 16 (here, a blade) mounted on an insulating body 18. It is sometimes desirable for some of the connections to be made before other connections when a male connector assembly is mated with a complementary female connector assembly during a procedure called actuation. This can be accomplished by providing modules with different "mating levels," so that the blades of some of the complementary module pairs mate before the blades of other complementary module pairs. As a result, the forces required for actuation frequently change along the length of engagement for the connector assembly 10 during the actuation process, with the center of force being dependent on which modules have engaged. The changing locations of the forces exerted on the connector assemblies during actuation produce moments (the product of force and distance) that may vary during actuation. This causes stress on the connector assemblies and the PWCs on which they are mounted, and can also cause a degree of misalignment of the blades themselves and thereby undermine the reliability of the connections. Moreover, the total required force that is needed during the peak mating level can easily exceed fifty pounds if the number of modules employed in a connector assembly is relatively large.

SUMMARY OF THE INVENTION

It is, therefore, a principle object of this invention to provide improved mechanical support for modular connector systems.

It is another object of the invention to provide an improved modular connector system in which a first modular connector assembly can be moved into mating relationship with a second modular connector assembly with a reduced degree of tilting between the modular connector assemblies.

In accordance with a first aspect of the present invention, these and other objects that will become apparent in the ensuing detailed description can be attained by providing a first connector assembly for use with a second connector assembly to convey electricity (signals and/or power) between the first and second connector assemblies when they are mated to one another. The first connector assembly includes a plurality of connector modules, at least one actuation module, and a support for connecting the connector modules and at least one actuation module together in an array. Each of the connector modules includes a body of insulating material and at least one contact conductor supported by the insulating material to provide electrical contact with the second connector assembly. Each of the at least one actuation modules is configured to be coupled to an actuator mechanism for moving the first connector assembly with respect to the second connector assembly.

In accordance with a second aspect of the invention, a connector system electrically connects wiring on a first printed wiring board to wiring on a second printed wiring board that is disposed adjacent the first printed wiring board and substantially perpendicular to it. The connector system includes a first connector assembly that is electrically connected to the wiring on the first printed wiring board and a second connector assembly that is electrically connected to the wiring on the second printed wiring board. The second connector assembly is complementary to the first connector assembly and can be mated to the first connector assembly. The first connector assembly is configured in accordance with the first aspect of the invention.

In accordance with a third aspect of the invention, a method for connecting wiring on a first printed wiring board to wiring on a second printed wiring board that is disposed adjacent the first printed wiring board and substantially perpendicular to the first printed wiring board includes the steps of (a) connecting the wiring on the first printed wiring board to a first connector assembly, the first connector assembly comprising a row of connector modules and a plurality of actuation modules interspersed in the row; (b) connecting the wiring on the first printed wiring board to a second connector assembly that is complementary to the first connector assembly; and (c) moving the first connector assembly into mating relationship with the second connector assembly using an actuator that is connected to the actuation modules.

DESCRIPTION OF THE PREFERRED EMBODIMENTS

Figure 1:
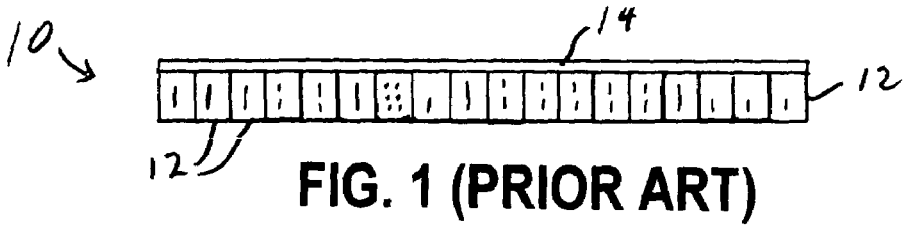
FIG. 1 (PRIOR ART)
FIG. 1 illustrates a conventional connector assembly that includes a number of connector modules.
Figure 2:
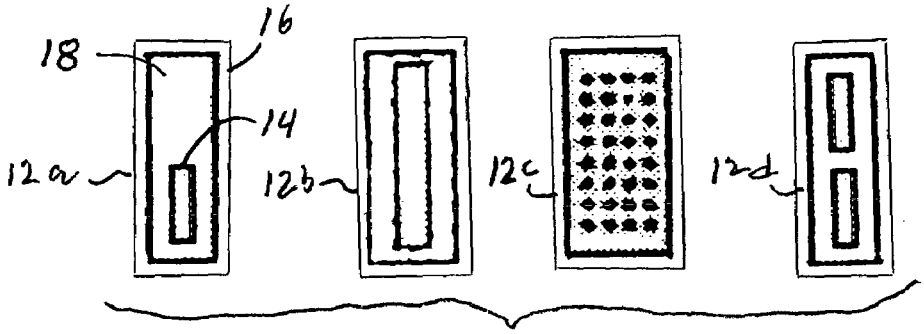
FIG. 2 (PRIOR ART)
FIG. 2 illustrates different types of connector modules.
Figure 3:
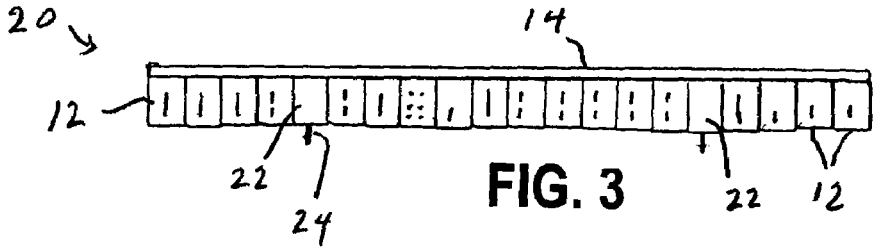
FIG. 3 illustrates a connector assembly that includes actuation modules along with connector modules.

A first embodiment of the present invention will now be described with reference to FIGS. 3 and 4. In FIG. 3, a connector assembly 20 includes a number of connector modules 12 that are mounted in a row on a support such as an organizer 14. Interspersed among the connector modules 12 are a pair of actuator modules 22 that are also mounted on the organizer 14. The actuator modules 22 have engagement studs 24 that project outward in a direction perpendicular to the blades of the connector modules 12.

Figure 4:
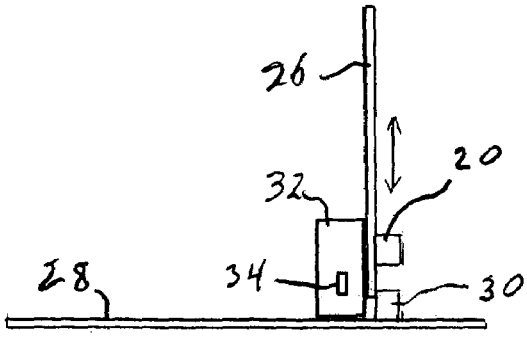
FIG. 4 is a side view of a first embodiment of the present invention.

In FIG. 4, the connector 20 is electrically connected to wiring or a printed wiring board (PWC) 26. For the sake of convenient illustration, the PWC 26 is shown without the integrated circuits and so forth that it would ordinarily carry. Likewise, a PWC 28 is shown in FIG. 4 without the electrical components that would normally be connected to it.

A connector assembly 30 is connected to wiring on the PWC 28. The connector assembly 20 has male-type modules 12, so the assembly 30 includes female-type connector modules that are located in alignment with the corresponding modules 12 of the connector assembly 20 when the assemblies 20 and 30 were positioned as shown in FIG. 4. The actuator studs 24 extend through holes (not shown) in the PWB 26 and are engaged by an actuator mechanism 32, which is provided with an operating lever 34. Using the operating lever 34, a technician can cause the actuator mechanism 32 to move the engagement studs 24 downward, thus also drawing the connector assembly 20 downward. One of the actuator modules 22 shown in FIG. 3 divides the left half of the connector assembly 20 into fairly equal portions, and the other actuator module 22 divides the right half into fairly equal portions. The result is a fairly uniform downward force on the assembly 20. Alternative designs which provide for the mechanism to be on opposite sides of the PWC are possible.

Should it ever be necessary to disconnect the connector assemblies 20 and 30, the actuator assembly 32 can be used for this purpose, too.

It will be apparent to those skilled in the art that the actuator mechanism 32 can be implemented in a number of different ways. It can, for example, include an electrical motor and gearing that moves a member having a slot for accepting the engagement studs 24. Alternatively, it can be entirely mechanical. One possibility here would be an articulated arrangement of links that cooperate in the manner of a scissors jack.

A second embodiment of the present invention will now be described with reference to FIGS. 5–8.

Figure 5:
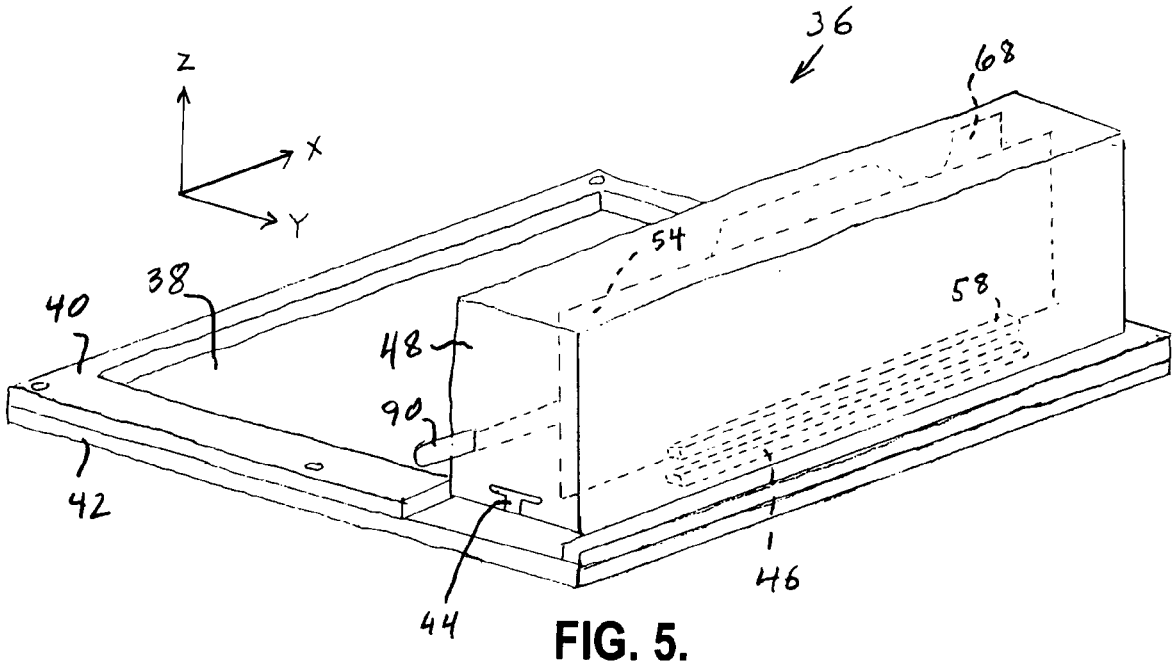
FIG. 5 is a perspective view of a processor unit book employing a second embodiment in accordance with the present invention.

FIG. 5 illustrates a processor unit book 36 having a PWC 38 on which electrical components (not illustrated) are mounted. The PWC 38 is supported between an upper framing member 40 and a lower framing member 42. The member 40 has an opening, and a guide rail 44 is exposed through this opening. The guide rail 44 is mounted on the lower framing member 44 and extends in the X direction. A lower connector assembly 46 is electrically connected to wiring on the PWC 38.

A direct current adaptor unit 48 has an elongated opening (not numbered) that conforms in shape to the guide rail 44. This permits the unit 48 to be inserted onto the guide rail 44 and moved in the X direction to the position illustrated in FIG. 5.

Figure 6:
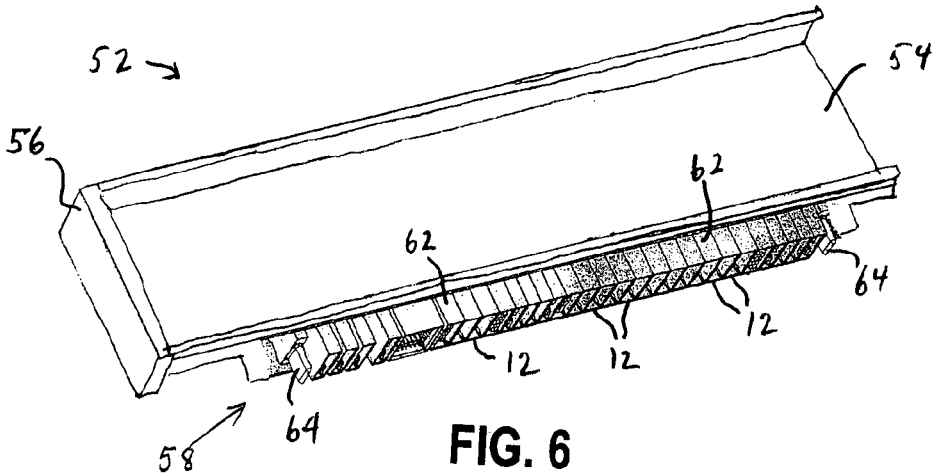
FIG. 6 is a perspective view of a power supply component in a direct current adaptor that is shown in FIG. 5.

The unit 48 includes a component 52, which is shown in FIG. 6. The component 52 includes a PWC 54 that is mounted on a frame 56. HV blades of a connector assembly 58 convey a power supply voltage (for example, 350 volts DC) to the component 52. The PWC 54 is densely populated with integrated circuits (not shown) that step down and regulate the input voltage. This step-down in the voltage causes a corresponding increase in the current, which is delivered to circuitry on the PWC 38 by way of LV blades of the connector assembly 58. The assembly 58 includes a row of connector modules 12 that are joined to an organizer 60 (not shown in FIG. 6, but bearing reference number 60 in FIG. 8). Two actuator modules 62 are interspersed among the connector modules 12. At either end, the upper connector assembly 58 has alignment prongs 64 that plug into corresponding alignment slots (not illustrated) at the ends of the lower connector assembly 46.

Figure 8:
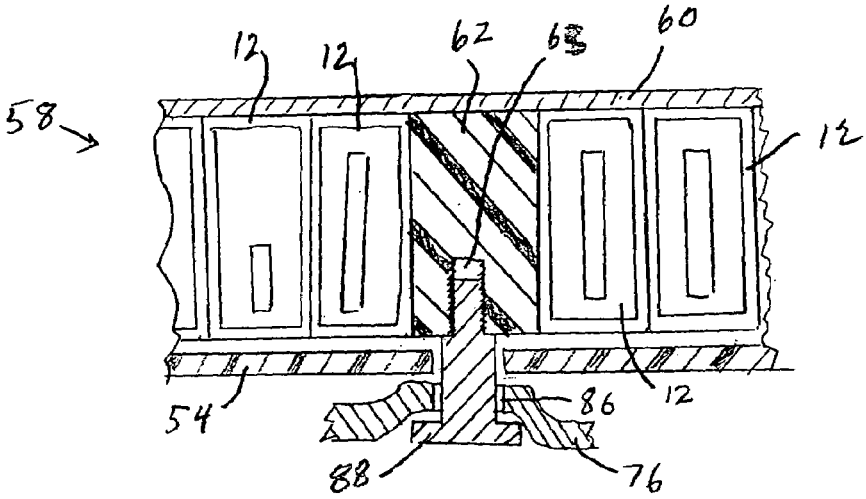
FIG. 8 illustrates a portion of a connector assembly that is shown in FIG. 6 joined by a shoulder screw to an arm member of the actuator mechanism shown in FIG. 7.

Turning now to FIG. 8, each actuator module 62 includes a body of material with a threaded bore 63 in it. The axis of the bore 64 is perpendicular to the direction in which the blades of the modules 12 extend.

Figure 7:
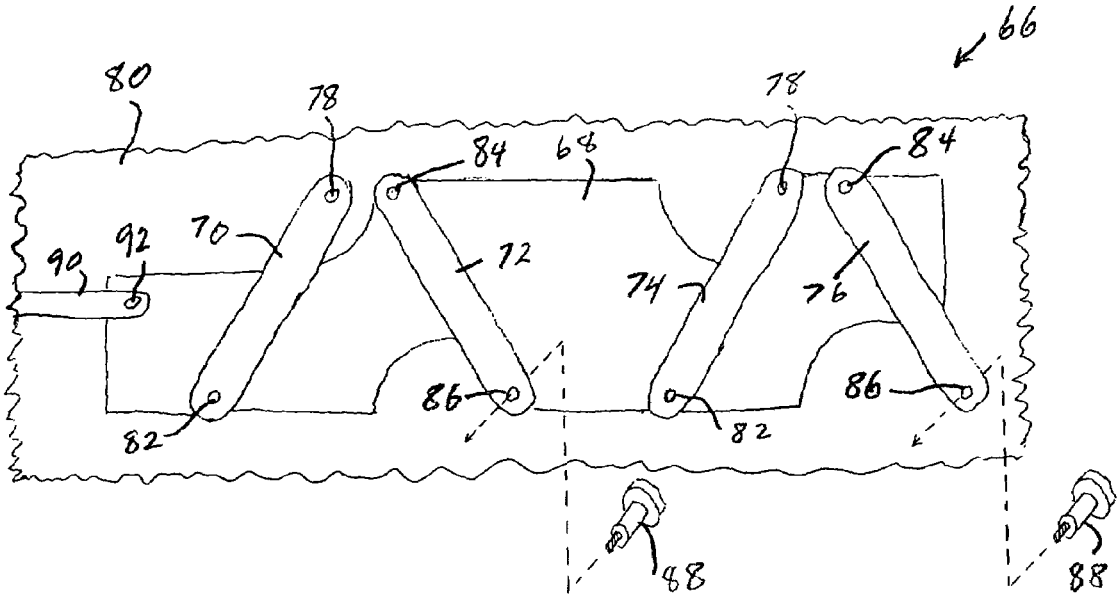
FIG. 7 is a side view of an actuator mechanism within the direct current adaptor shown in FIG. 5.

The processor unit book 36 also includes an actuator mechanism 66, which is shown in FIG. 7. The actuator mechanism 66 includes a plate 68 and arm members 70, 72, 74, and 76. Fasteners 78 join the upper ends of arm members 70 and 74 to a back wall 80 of the housing of the direct current adaptor unit 48. The connection of the arm members 70 and 74 to the wall 80 is not a tight one; instead, the fasteners 78 permit the arm members 70 and 74 to pivot with respect to the wall 80. Fasteners 82 connect the lower ends of the arm members 70 and 74 to the plate 68. Here, too, the connection is not a tight one, so that the arm members 70 and 74 are pivotable with respect to the plate 68.

The upper ends of arm members 72 and 76 are pivotably connected to the plate 60 by fasteners 84. At their lower ends, their members 72 and 76 have holes 86. Shoulder screws 88 extend through the holes 86.

The arm member 76 is connected to the connector assembly 58 in the manner shown in FIG. 8 (the arm member 72 is connected in the same manner). The shoulder screw 88 extends through the hole 86 at the lower end of the arm member 76 and through an opening (not numbered) in the PWC 54. It screws into the threaded bore 64 of the actuation module 62. In this way, the connector assembly 58 is operatively connected to the actuator mechanism 66 by way of the shoulder screws 88. In the operatively-connected state, what is shown in FIG. 8 would be rotated so that the connector modules 12 in FIG. 8 would face downward in FIG. 7 and the bore 64 would be perpendicular to the plane of FIG. 7.

The outer end of a link arm 90 extends outside the housing of the unit 48, as shown in FIG. 5.

Referring now to FIG. 7, if the arm 90 is pushed to the right, it will be apparent that arm members 70 and 74 will rotate in the counterclockwise direction and carry the plate 68 with them in a descending arc. This movement of the plate 68 also causes a corresponding movement of the upper ends of the arm members 72 and 74, but the arm members 72 and 74 are free to rotate in the clockwise direction with respect to the plate 68. The net result of the movement of plate 68 in a downward arc and the clockwise rotation of the arm members 72 and 76 is to force the shoulder screws 88 downward. This, of course, also moves the upper connector assembly 58 into mating engagement with the lower connector assembly 46.

It will be understood that the above description of the present invention is susceptible to various modifications, changes and adaptations, and the same are intended to be comprehended within the meaning and range of equivalents of the appended claims.

What is claimed is:

1. A connector system for electrically connecting wiring on a first printed wiring board to wiring on a second printed wiring board that is disposed adjacent the first printed wiring board and substantially perpendicular to it, comprising:

a first connector assembly that is electrically connected to the wiring on the first printed wiring board; and a second connector assembly that is complementary to the first connector assembly and that is electrically connected to the wiring on the second printed wiring board, the first and second connector assemblies conveying electricity between the first and second printed wiring boards when the first and second connector assemblies are mated together, wherein the first connector assembly comprises a plurality of connector modules, each including a body of insulating material and at least one contact conductor supported by the insulating material to provide electrical contact with the second connector assembly;

at least one actuation module that is configured to be coupled to an actuator mechanism for moving the first connector assembly with respect to the second connector assembly; and a support for connecting the connector modules and at least one actuation module together in an array.

2. The connector system of claim 1, wherein each at least one actuator module includes a body but not contact conductors.

3. The connector system of claim 1, in combination with the actuator mechanism, wherein the actuator mechanism comprises a swingably mounted plate and at least one arm member pivotably connected to the plate, the at least one arm member additionally being coupled to the at least one actuation module.

4. The connector system of claim 1, wherein the array is a row.

5. The connector system of claim 4, wherein each said at least one actuation module has a body and a bore in its body.

6. The connector system of claim 5, wherein the contact conductors of the connector modules extend in a predetermined direction, and the bore of each said at least one actuation module extends in a direction substantially perpendicular to the predetermined direction.

7. The connector system of claim 6, wherein the bore of each said at least one actuation module is a bore threaded to receive a screw.

8. The connector system of claim 1, wherein each said at least one actuation module has a body and a stud extending from its body.

9. The connector system of claim 8, wherein the contact conductors of the connector modules extend in a predetermined direction, and the stud of each said at least one actuation module extends in a direction substantially perpendicular to the predetermined direction.

10. A method for connecting wiring on a first printed wiring board to wiring on a second printed wiring board that is disposed adjacent the first printed wiring board and substantially perpendicular to the first printed wiring board, comprising:

(a) connecting the wiring on the first printed wiring board to a first connector assembly, the first connector assembly comprising a row of connector modules and a plurality of actuation modules interspersed in the row;

(b) connecting the wiring on the second printed wiring board to a second connector assembly that is complementary to the first connector assembly; and (c) aligning the first and second connector assemblies; and (d) moving the first connector assembly into mating relationship with the second connector assembly using an actuator mechanism that is coupled to the actuation modules.

11. The method of claim 10, wherein step (c) comprises moving one of the connector assemblies in a direction substantially parallel to the row thereof.

12. The method of claim 10, wherein the connector modules in the first connector assembly have contact conductors that extend in a first direction and the actuation modules have bores extending in a second direction that is substantially perpendicular to the first direction, and further comprising connecting the actuation modules to the actuation modules with screws that extend into the bores.

* * * * *